US009796541B2

(12) United States Patent
Takahashi et al.

(10) Patent No.: US 9,796,541 B2
(45) Date of Patent: Oct. 24, 2017

(54) SHEET FEEDER AND IMAGE FORMING APPARATUS

(71) Applicant: Konica Minolta, Inc., Chiyoda-ku, Tokyo (JP)

(72) Inventors: Masaki Takahashi, Toyokawa (JP); Hideyuki Nukumi, Ama-gun (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/014,377

(22) Filed: Feb. 3, 2016

(65) Prior Publication Data

US 2016/0244284 A1 Aug. 25, 2016

(30) Foreign Application Priority Data

Feb. 25, 2015 (JP) ..... 2015-035162

(51) Int. Cl.
*B65H 1/04* (2006.01)
*G03G 15/00* (2006.01)

(52) U.S. Cl.
CPC ..... *B65H 1/04* (2013.01); *G03G 15/6511* (2013.01); *G03G 15/6514* (2013.01);
(Continued)

(58) Field of Classification Search
CPC . B65H 1/04; B65H 3/66; B65H 31/20; B65H 2402/31; B65H 2405/32;
(Continued)

(56) References Cited

U.S. PATENT DOCUMENTS

2006/0182485 A1 8/2006 Ogawa
2011/0163495 A1* 7/2011 Aoyama ..... B65H 1/266 271/241

(Continued)

FOREIGN PATENT DOCUMENTS

CN 1821039 A 8/2006
CN 103733139 A 4/2014

(Continued)

OTHER PUBLICATIONS

Notification of Reason(s) for Refusal referring to Application No. JP2015-035162, with English Translation; Mailing Date of Feb. 14, 2017.

(Continued)

*Primary Examiner* — David H Bollinger
(74) *Attorney, Agent, or Firm* — Cantor Colburn LLP

(57) ABSTRACT

A sheet feeder includes a manual feeding tray to stack a sheet, the tray being openable and closable to a main body by rotation about a rotation axis in a direction perpendicular to a sheet feeding direction; a sheet width regulating member provided in the manual feeding tray to regulate a side edge of the sheet in a sheet width direction and to have a variable regulating width; an auxiliary tray that does not move with an opening/closing operation of the manual feeding tray and stacks the sheet with the manual feeding tray; a sheet width regulating member provided in the auxiliary tray to regulate the side edge of the sheet and to have a variable regulating width; a link member interlocking the regulating members; and a feeding roller provided in the main body to individually feed the sheet stacked over the manual feeding tray and the auxiliary tray.

21 Claims, 9 Drawing Sheets

(52) U.S. Cl.
CPC .. *B65H 2403/411* (2013.01); *B65H 2403/533* (2013.01); *B65H 2405/324* (2013.01); *B65H 2407/21* (2013.01); *B65H 2511/10* (2013.01); *B65H 2511/12* (2013.01); *B65H 2511/22* (2013.01); *B65H 2515/708* (2013.01)

(58) Field of Classification Search
CPC ..... B65H 2405/324; B65H 2405/35; B65H 2405/354; B65H 2511/12
USPC ..... 271/162, 171, 213, 223, 242
See application file for complete search history.

(56) References Cited

U.S. PATENT DOCUMENTS

2011/0227277 A1* 9/2011 Wada ..... B65H 1/266 271/162
2012/0187622 A1* 7/2012 Kamichi ..... B65H 1/04 271/171
2013/0011174 A1* 1/2013 Lee ..... G03G 21/1633 399/381
2013/0250328 A1* 9/2013 Ohtsuka ..... H04N 1/0066 358/1.13
2014/0186083 A1 7/2014 Lee
2014/0291919 A1* 10/2014 Arimura ..... B65H 1/04 271/171
2015/0239687 A1* 8/2015 Shinkawa ..... B65H 7/02 271/171

FOREIGN PATENT DOCUMENTS

JP H05319635 A 12/1993
JP 2001039587 A 2/2001
JP 2004075306 A 3/2004
JP 2005298112 A 10/2005
JP 2006248781 A 9/2006
JP 2009057122 A 3/2009
JP 2010143701 A 7/2010
JP 2012005064 A 1/2012
JP 2014214014 A 11/2014
JP 2016128344 A 7/2016

OTHER PUBLICATIONS

SIPO First Office Action corresponding to Application No. 201610098809.1; Mailing date of Mar. 24, 2017; with English translation.
Japanese Notification of Reasons for Refusal corresponding to Application No. JP2015-035162; dated Jul. 4, 2017.

* cited by examiner

SHEET FEEDER AND IMAGE FORMING APPARATUS

CROSS-REFERENCE TO RELATED APPLICATIONS

This application is based upon and claims the benefit of priority from the prior Japanese Patent Application No. 2015-035162 filed on Feb. 25, 2015, the entire contents of which are incorporated herein by reference.

BACKGROUND OF THE INVENTION

1. Field of the Invention

The present invention relates to a sheet feeder for supplying a sheet(s) of paper to an image forming section of an image forming apparatus, and the image forming apparatus using the sheet feeder, and more particularly to a sheet feeder having a sheet stacking tray provided to be opened and closed with respect to a main body and being mainly suitable for manual sheet feeding, and an image forming apparatus using the sheet feeder.

2. Description of Related Art

Conventionally, an image forming apparatus is provided with a manual sheet feeder formed of an outer panel a part of which will be opened to allow manual loading of a sheet(s) therein in addition to a sheet cassette for supplying a sheet(s) therefrom. One example of such sheet feeders is disclosed in Japanese patent application publication No. 2005-298112. The sheet feeder in this publication is provided with guide members placed in contact with side edges of a stack of sheets to regulate the stacked sheets. Each guide member includes a posture maintaining means at one end to maintain the posture of the guide member. Each guide member further includes a pressing means at the other end to press the side edges of the stacked sheets. These guide members are used to prevent skewing (oblique shift) of a sheet to be conveyed.

However, the conventional sheet feeder mentioned above has the following disadvantages. In response to recent demands for downsizing of apparatus, it is becoming difficult to prevent the occurrence of sheet skewing. In association with downsizing of the image forming apparatus, a sheet tray such as a manual sheet feeding tray to be used by opening and closing a part of the apparatus also has been reduced in size of a lifting plate and other surrounding parts or components. Accordingly, sheet guides additionally provided in the lifting plate also have been reduced in size. This is a disadvantageous condition to prevent sheet skewing. Size reduction of the sheet guides will cause difficulty in adjusting the sheet guides to fit close to the sheet width. This is because such small sheet guides are unnoticeable and also difficult to grasp.

The present invention has been made to solve the foregoing problems of the conventional techniques. Specifically, the present invention has objects of providing a sheet feeder capable of properly conveying a sheet loaded on a tray with even an apparatus configuration adapted for downsizing, and providing an image forming apparatus using the sheet feeder.

SUMMARY OF THE INVENTION

To achieve at least one of the abovementioned objects, one aspect of the present invention provides a sheet feeder comprising: a sheet stacking tray provided to stack a sheet to be supplied to a main body, the sheet stacking tray being configured to be opened and closed with respect to the main body by rotation about a rotation axis defined in a direction perpendicular to a sheet feeding direction; a first width regulating member provided in the sheet stacking tray and configured to regulate a side edge of the sheet in a sheet width direction and to have a variable regulating width; an auxiliary tray provided at a position in the main body where the auxiliary tray does not move in association with an opening/closing operation of the sheet stacking tray, the auxiliary tray being configured to stack the sheet in cooperation with the sheet stacking tray; a second width regulating member provided in the auxiliary tray and configured to regulate the side edge of the sheet in the sheet width direction and to have a variable regulating width; a link member interlocking the first width regulating member and the second width regulating member in a regulating width changing operation; and a sheet feeding member provided in the main body and configured to feed one by one the sheets stacked over the sheet stacking tray and the auxiliary tray.

In the sheet feeder in the above aspect, sheet feeding from the sheet stacking tray is performed while the sheet stacking tray is in an open position. A sheet(s) to be fed from the sheet stacking tray is stacked over the sheet stacking tray and the auxiliary tray. The side edge of the sheet(s) in the sheet width direction is regulated by the first width regulating member on the sheet stacking tray and by the second width regulating member on the auxiliary tray. Since the first width regulating member and the second width regulating member are interlocked with each other through the link member, these regulating members regulate the sheet(s) with the same regulating width. Under such a regulation in the sheet width direction by the first width regulating member and the second width regulating member, sheets stacked on the sheet stacking tray and the auxiliary tray are fed one by one by the sheet feeding member.

In the sheet feeder configured as above, regulating the sheet(s) in the width direction is performed on both the sheet stacking tray and the auxiliary tray. Thus, the first width regulating member and the second width regulating member, even though they are individually small in size, can provide as a whole a great regulating effect in the width direction and also can be visible to a user. Since the sheet(s) is subjected to width-direction regulation even on the auxiliary tray located near the sheet feeding member, the occurrence of sheet skewing can be satisfactorily prevented.

Another aspect of the present invention provides an image forming apparatus provided with an image forming section and a sheet feeder for supplying a sheet to the image forming section, wherein the sheet feeder is configured in the above aspect.

DESCRIPTION OF EMBODIMENTS

Figure 1:
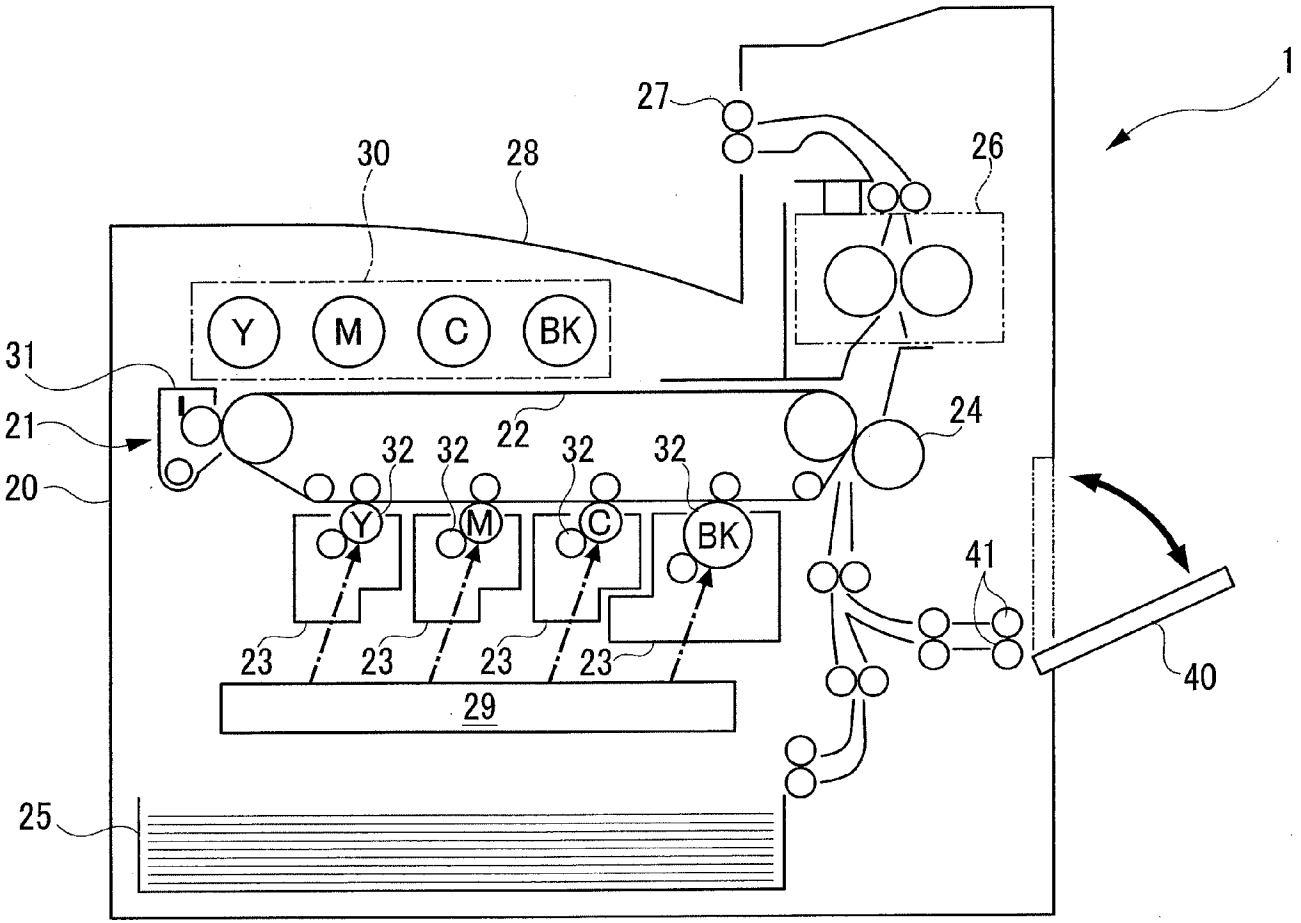
FIG. 1 is a sectional view showing a schematic structure of an image forming apparatus in an embodiment.

A detailed description of preferred embodiments of the present invention will now be given referring to the accompanying drawings. In the present embodiment, the invention is applied to an image forming apparatus 1 shown in FIG. 1. The image forming apparatus 1 in FIG. 1 is provided with an image forming section 21 in a main body 20. The image forming section 21 includes an intermediate transfer belt 22, four-color image forming units 23, and a transfer roller 24. Each of the image forming units 23 has a corresponding photoconductor drum 32. Below the image forming section 21, a sheet cassette 25 is placed. This apparatus is configured to form a toner image through the image forming section 21 and transfer the formed toner image onto a sheet supplied from the sheet cassette 25, thereby forming an image.

The image forming apparatus 1 is further provided with a fixing section 26, ejecting rollers 27, and an output tray 28. Accordingly, a sheet formed with an image is stacked onto the output tray 28. The image forming apparatus 1 is further provided with an exposer 29, a toner supplying section 30, a belt cleaner 31, and others, which are auxiliary devices for image formation in addition to the foregoing sections or components.

Besides the above components, the image forming apparatus is further provided with a manual feeding tray (a sheet stacking tray) 40. This manual feeding tray 40 can be opened and closed. In a closed state, the manual feeding tray 40 forms a part of an outer panel of the image forming apparatus 1. In an open state shown with a solid line in FIG. 1, the manual feeding tray 40 allows a user to load a sheet(s) thereon. During image formation in the image forming apparatus 1, feeding a sheet to the image forming section 21 can be performed from the manual feeding tray 40 instead of the sheet cassette 25. In a position just inside the manual feeding tray 40, manual sheet feeding rollers (sheet feeding members) 41 are provided to bring in a sheet from the manual feeding tray 40. The details of the manual feeding tray 40 will be explained below.

Figure 2:
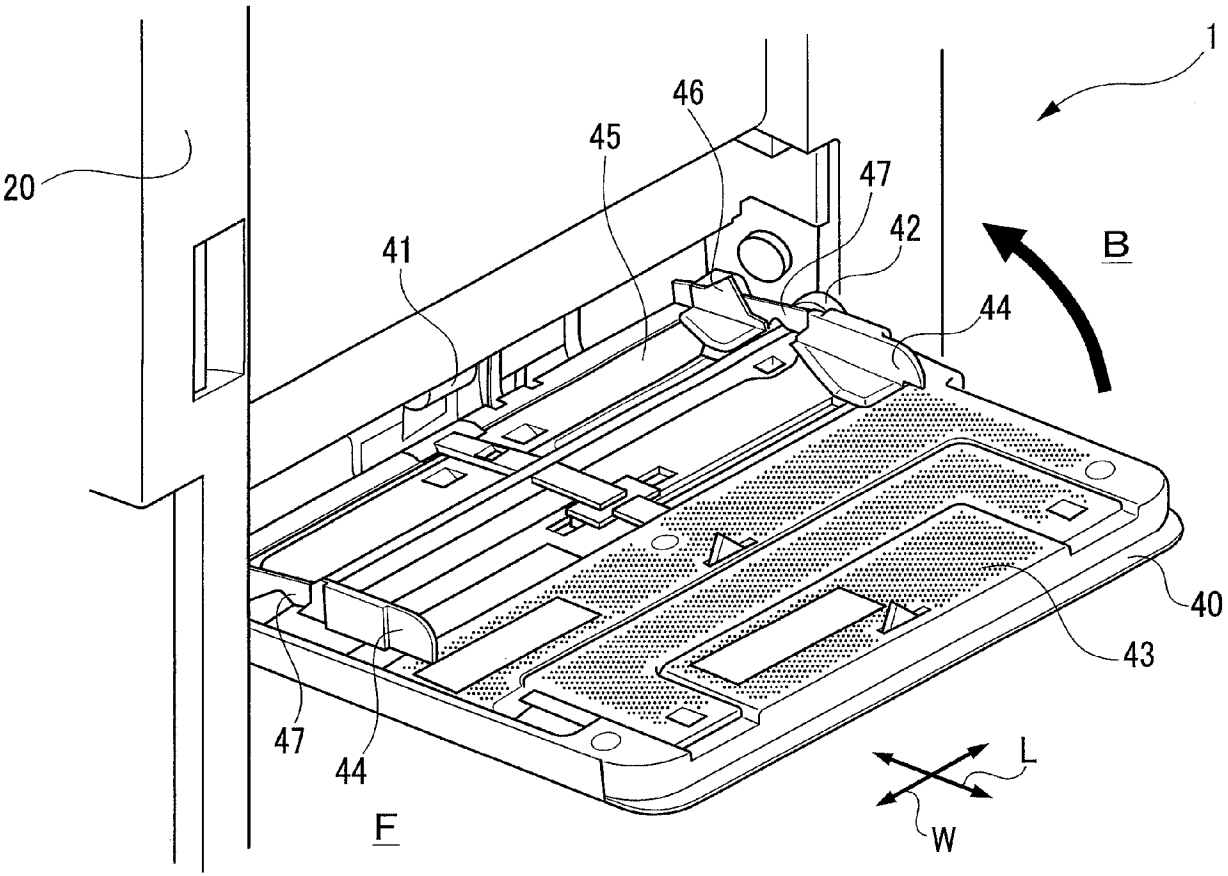
FIG. 2 is a view showing a manual feeding tray in an open state in the image forming apparatus of the embodiment.

FIG. 2 shows an open state of the manual feeding tray 40. The manual feeding tray 40 shown in FIG. 2 can be opened and closed with respect to the main body 20 by rotation about a rotating shaft 42. The manual feeding tray 40 itself has a nearly rectangular plate-like shape. An upper surface of the manual feeding tray 40 in FIG. 2, that is, a surface which becomes an internal surface of the image forming apparatus 1 when the manual feeding tray 40 is closed, corresponds to a sheet stacking surface 43. In FIG. 2, a left lower side indicated by "F" corresponds to a front side of the image forming apparatus 1, i.e., a side at which a user will stand in use. On the other hand, a right upper side indicated by "B" corresponds to a rear side of the image forming apparatus 1. A direction from the front side to the rear side in FIG. 2 corresponds to a width direction W of a sheet. A direction from upper left to lower right, perpendicular to the width direction on a horizontal plane is a longitudinal direction L of a sheet. The rotating shaft 42 is placed in parallel to the width direction W. The sheet feeding direction is of course parallel to the longitudinal direction L.

On the sheet stacking surface 43 of the manual feeding tray 40, sheet width regulating members (first width regulating members) 44 are placed one on each of the front F side and the rear B side. The sheet width regulating members 44 are used to regulate both side edges, in the width direction W, of a sheet(s) stacked on the sheet stacking surface 43. The sheet width regulating members 44 are slidable symmetrically on the F side and the B side in the width direction W on the sheet stacking surface 43. Accordingly, various sheet sizes can be treated. Such sheet width regulating members 44 are located on the manual feeding tray 40 on a side close to the main body 20.

In FIG. 2, an auxiliary tray 45 is placed downstream adjacent to the manual feeding tray 40 in the sheet feeding direction. This auxiliary tray 45 is provided in the main body 20. Thus, even when the manual feeding tray 40 is rotated to be opened and closed, the auxiliary tray 45 moves little. A sheet(s) loaded on the sheet stacking surface 43 of the manual feeding tray 40 is placed over not only the sheet stacking surface 43 but also the auxiliary tray 45. The auxiliary tray 45 also functions as a so-called lifting plate. Further, just inside the auxiliary tray 45, the manual sheet feeding rollers 41 are visible.

The auxiliary tray 45 is also provided with sheet width regulating members (second width regulating members) 46. In FIG. 2, only the sheet width regulating member 46 on the B side is visible; however, the sheet width regulating members 46 are actually placed both on the F side and the B side as with the sheet width regulating members 44. The sheet width regulating members 46 are also used to regulate both side edges of the stacked sheet(s) in the width direction W as with the sheet width regulating members 44. Further, each link member 47 is provided on each of the F side and the B side to interlock the sheet width regulating members 44 and the corresponding sheet width regulating members 46. Accordingly, when the sheet width regulating members 44 are slid as above, the corresponding sheet width regulating members 46 are also slid in sync with the sheet width regulating members 44. Thus, the sheet width regulating members 44 and the sheet width regulating members 46 in combination correspond as a whole to the sheet size in the width direction.

Figure 3:
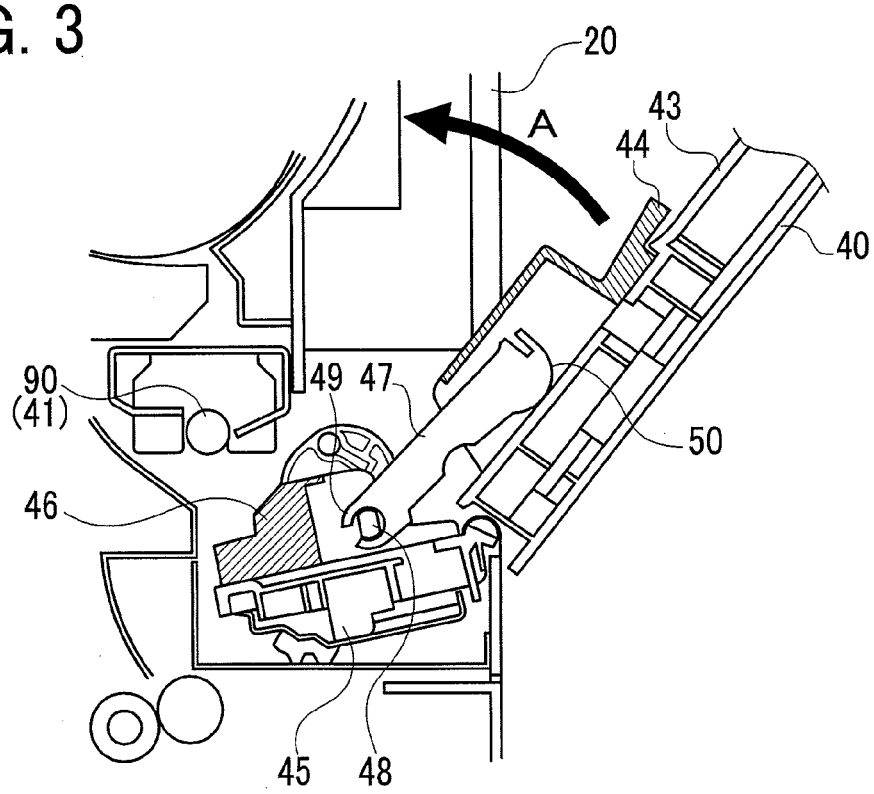
FIG. 3 is a sectional view (Part 1) of the manual feeding tray and an auxiliary tray in the embodiment.
Figure 4:
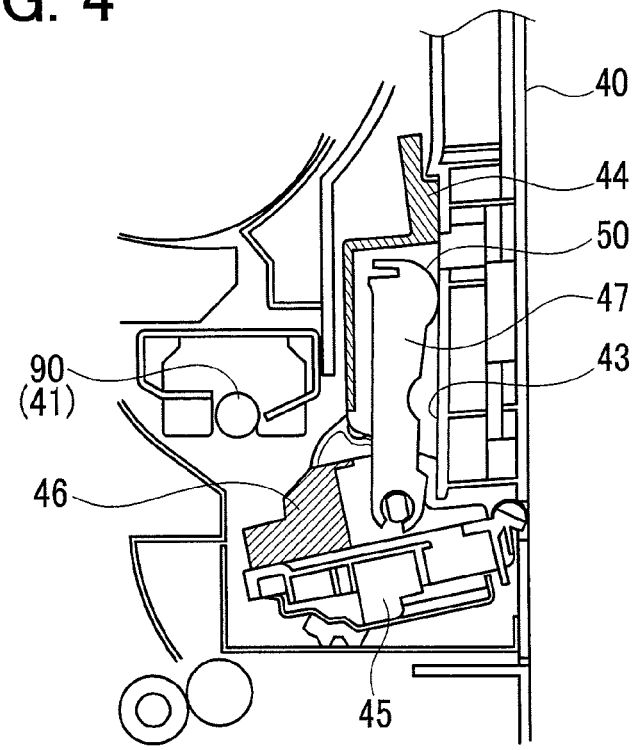
FIG. 4 is a sectional view (Part 2) of the manual feeding tray and the auxiliary tray in the embodiment.
Figure 5:
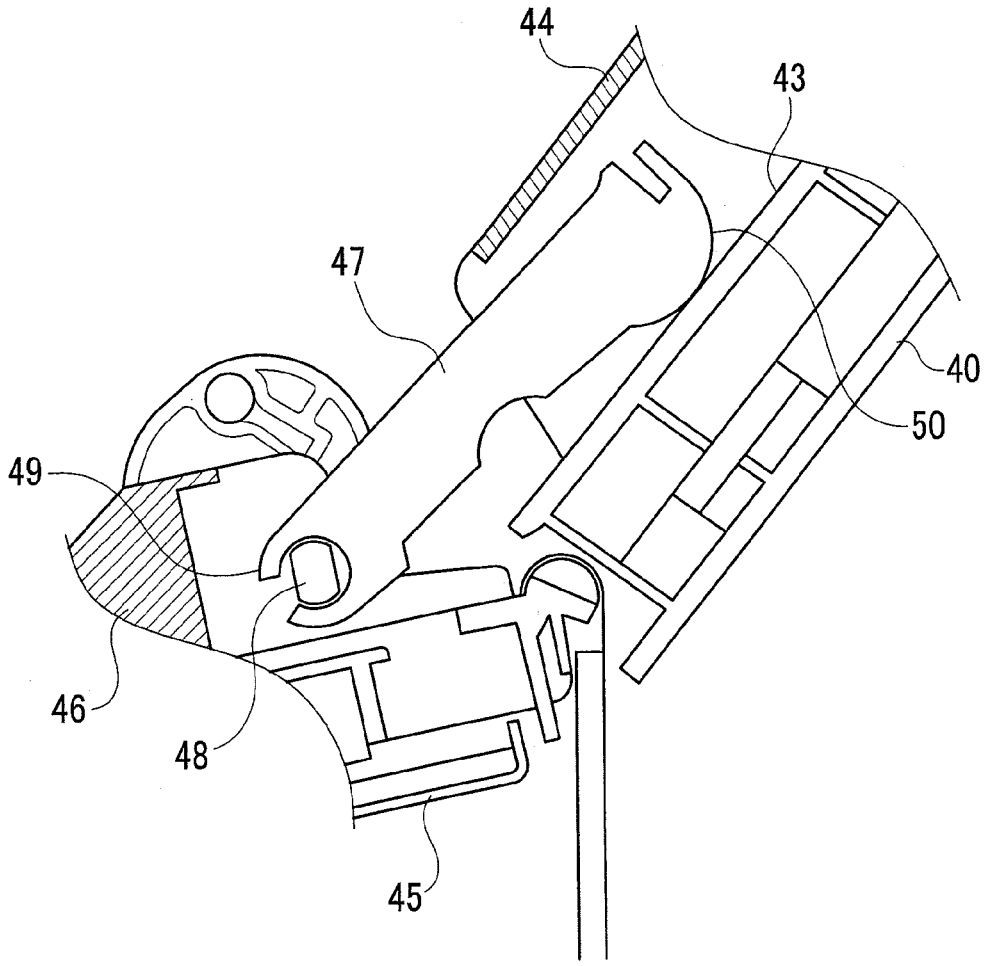
FIG. 5 is an enlarged view of a link member and its surrounding parts in FIG. 3.

The sheet width regulating members 44, the sheet width regulating members 46, and the link members 47 will be further explained referring to FIGS. 3 to 5. FIGS. 3 and 4 are views to explain a coupling state of the sheet width regulating member 44 and the sheet width regulating member 46 by the link member 47, in which these sheet width regulating member 44 and 46 are illustrated in section. Specifically, FIG. 3 shows a half-open state of the manual feeding tray 40 and FIG. 4 shows a fully closed state of the manual feeding tray 40. In FIGS. 3 and 4, a lower roller of the manual feeding rollers 41 is omitted and only a roller shaft 90 of the upper roller 41 is illustrated. FIG. 5 is an enlarged view of a part of FIG. 3.

As is clear from FIGS. 3 and 4, each of the sheet width regulating members 44 and 46 internally has a cavity or space area in which either end of the link member 47 is inserted. Thus, the sheet width regulating members 44 and 46 are regulated from each other in the width direction W with respect to the corresponding link member 47 so that the members 44 and 46 are can only be moved together.

The space area in each sheet width regulating member 46 opens at least on a side toward the corresponding sheet width regulating member 44 and on an opposite side to the auxiliary tray 45 (an upper side in FIG. 3). Furthermore, in the space area of each sheet width regulating member 46, a boss 48 is formed. This boss 48 is fixed to the sheet width regulating member 46. On the other hand, each link member 47 is formed, on one end, with an engagement portion 49. The sheet width regulating member 46 and the link member 47 are connected in such a way that the boss 48 is engaged with the engagement portion 49. This connection allows the link member 47 to rotate to some extent about the boss 48 of the sheet width regulating member 46. Each link member 47 rotates on a rotational plane which is perpendicular to the sheet stacking surface 43 of the manual feeding tray 40 and parallel to the sheet longitudinal direction L. That is, the rotation axis of each link member 47 is parallel to the width direction W.

Each link member 47 is formed, on the other end, with a rounded portion 50 having a convex shape protruding downward, i.e., toward the sheet stacking surface 43. Further, in the sheet width regulating member 44 in which the rounded portion 50 of the link member 47 is inserted, the internal space area opens toward the sheet width regulating member 46 and the lower side, i.e., toward the sheet stacking surface 43. Accordingly, the rounded portion 50 is placed in contact with the sheet stacking surface 43 within the sheet width regulating member 44.

Consequently, the sheet width regulating members 44, the sheet width regulating members 46, and the link members 47 provide as a whole a sheet width change adapting function and also react to the opening and closing operations of the manual feeding tray 40. Specifically, the operation of the manual feeding tray 40 from the open state to the closed state is counterclockwise tilting or flapping motion indicated by an arrow A in FIG. 3. This operation causes the sheet stacking surface 43 to come up, thereby pushing upward the rounded portion 50 of the link member 47. Accordingly, the link member 47 is rotated counterclockwise about the boss 48 in FIG. 3. Then, the manual feeding tray 40 comes to the closed state shown in FIG. 4. When the manual feeding tray 40 is to be opened from the closed state, an opposite behavior to the aforementioned one comes about. In this opening/closing operation, the rounded portion 50 slides on the sheet stacking surface 43 in parallel to the longitudinal direction L.

Sliding of the rounded portion 50 absorbs variations in distance between the sheet width regulating member 44 and the sheet width regulating member 46 caused by the opening/closing operation of the manual feeding tray 40. In this manner, the paired sheet width regulating members 44 and 46 are integrally moved in the width direction W and can adjust to the opening/closing operation of the manual feeding tray 40.

Figure 6:
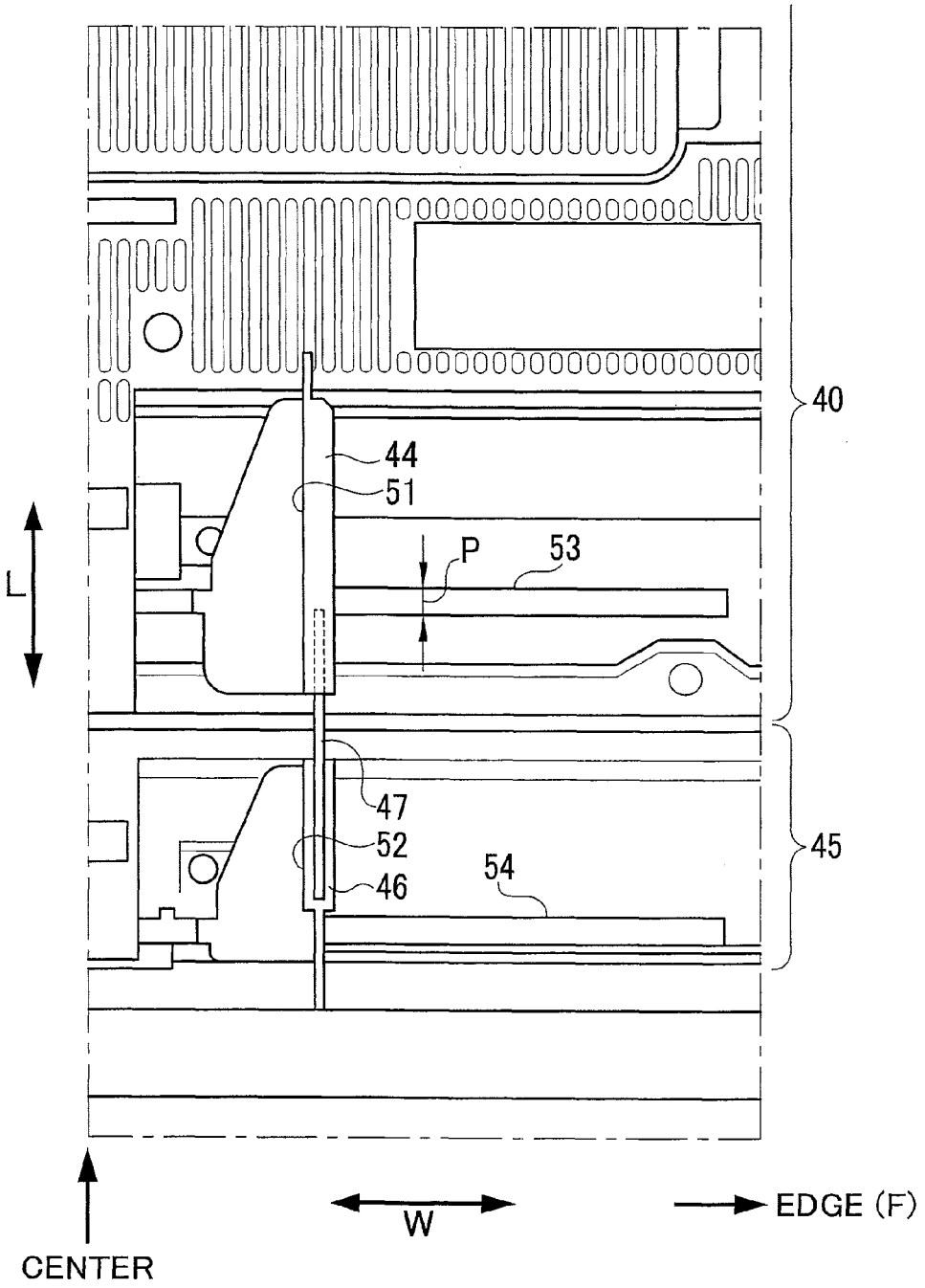
FIG. 6 is a plan view of part of the manual feeding tray and part of the auxiliary tray in the embodiment.

FIG. 6 is a plan view showing part of the manual feeding tray 40 in the open state and part of the auxiliary tray 45, seen from above. As shown in FIG. 6, the sheet width regulating member 44 and the sheet width regulating member 46 respectively have a sheet width regulating surface 51 and a sheet width regulating surface 52. Each of these sheet width regulating surfaces 51 and 52 is perpendicular to the sheet stacking surface 43 and parallel to the sheet longitudinal direction L. Those surfaces 51 and 52 serve to regulate the edges of a sheet(s) stacked over the manual feeding tray 40 and the auxiliary tray 45 to prevent sheet skewing. The link member 47 is located outside (a right side in FIG. 6) in the width direction W more than the sheet width regulating surfaces 51 and 52.

The sheet width regulating members 44, the sheet width regulating members 46, and the link members 47 are, as mentioned above, integrally moved in the width direction W to fit various sizes of the sheets in the width direction. For this end, the manual feeding tray 40 and the auxiliary tray 45 are respectively formed with a guide groove 53 and a guide groove 54 to guide movement of the sheet width regulating members 44 and the sheet width regulating member 46 in the width direction W. FIG. 6 shows that the sheet width regulating member 44 and the sheet width regulating member 46 are adjusted to positions closer to the center within their movable range in the width direction W, that is, positions corresponding to a small width sheet.

Herein, the rounded portion 50 of the above-mentioned link member 47 is designed such that a smallest curvature radius R of the convex shape is larger than the width P of the guide groove 53. Preferably, the curvature radius R is more than 1.1 times as large as the width P. This is because, as long as the curvature radius R is larger than the width P, even when the rounded portion 50 moves across the guide groove 53, the rounded portion 50 does not largely fall into the guide groove 53. This allows the rounded portion 50 to smoothly slide on the sheet stacking surface 43. In some apparatus structures, the guide groove 53 may be located within a slidable range of the rounded portion 50. In this case, it is necessary to take account of a relationship between the curvature radius R and the width P. For another apparatus structure in which the guide groove 53 is located out of the slidable range of the rounded portion 50, the above relationship does not need to be taken account. Each sheet width regulating member 44 may be formed with a bottom closing the cavity or space area in which the rounded portion 50 is placed, instead of allowing the cavity area opening toward the sheet stacking surface 43. In this case, the foregoing relationship between the curvature radius R and the width P also does not need to be considered.

Herein, as an alternative, the link member 47 may be configured, opposite to the above, such that one end is attached to be rotatable about a boss with respect to the sheet width regulating member 44 and the other end is slidable on the auxiliary tray 45 side. The relationship between the curvature radius R and the width P in such a case can be considered in relation to the width of the guide groove 54 if necessary.

Figure 7:
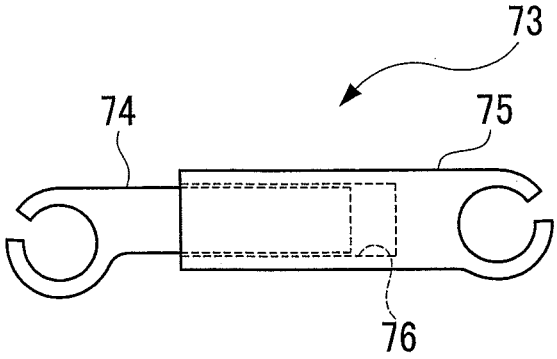
FIG. 7 is a front view (Part 1) of a link member in a modified example.
Figure 8:
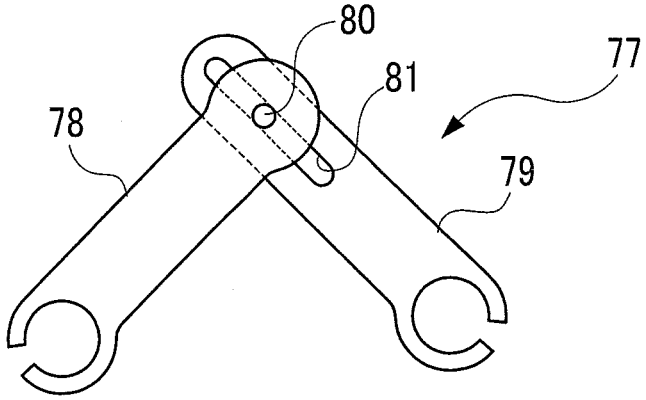
FIG. 8 is a front view (Part 2) of a link member in another modified example.

It is alternatively conceivable that the link member 47 is configured such that both the sheet width regulating member 44 and the sheet width regulating member 46 are attached to be rotatable about respective bosses and held against sliding with respect to the manual feeding tray 40 or the auxiliary tray 45. In this case, however, the distance between both ends of the link member 47 has to be variable. It is accordingly conceivable that the link member is made up of two pieces as shown in FIG. 7 or 8, for example. Specifically, a link member 73 shown in FIG. 7 is made up by combining a first link member 74 and a second link member 75 having a sheath-like shape formed with a hole 76. Sliding part of the first link member 74 within the hole 76 allows the distance between both ends of the whole link member 73 to be changed. A link member 77 shown in FIG. 8 is made up by connecting a first link member 78 and a second link member 79 through a slit 81 and a sliding portion 80. Sliding the sliding portion 80 within the slit 81 allows the distance between both ends of the whole link member 77 to be changed.

Figure 9:
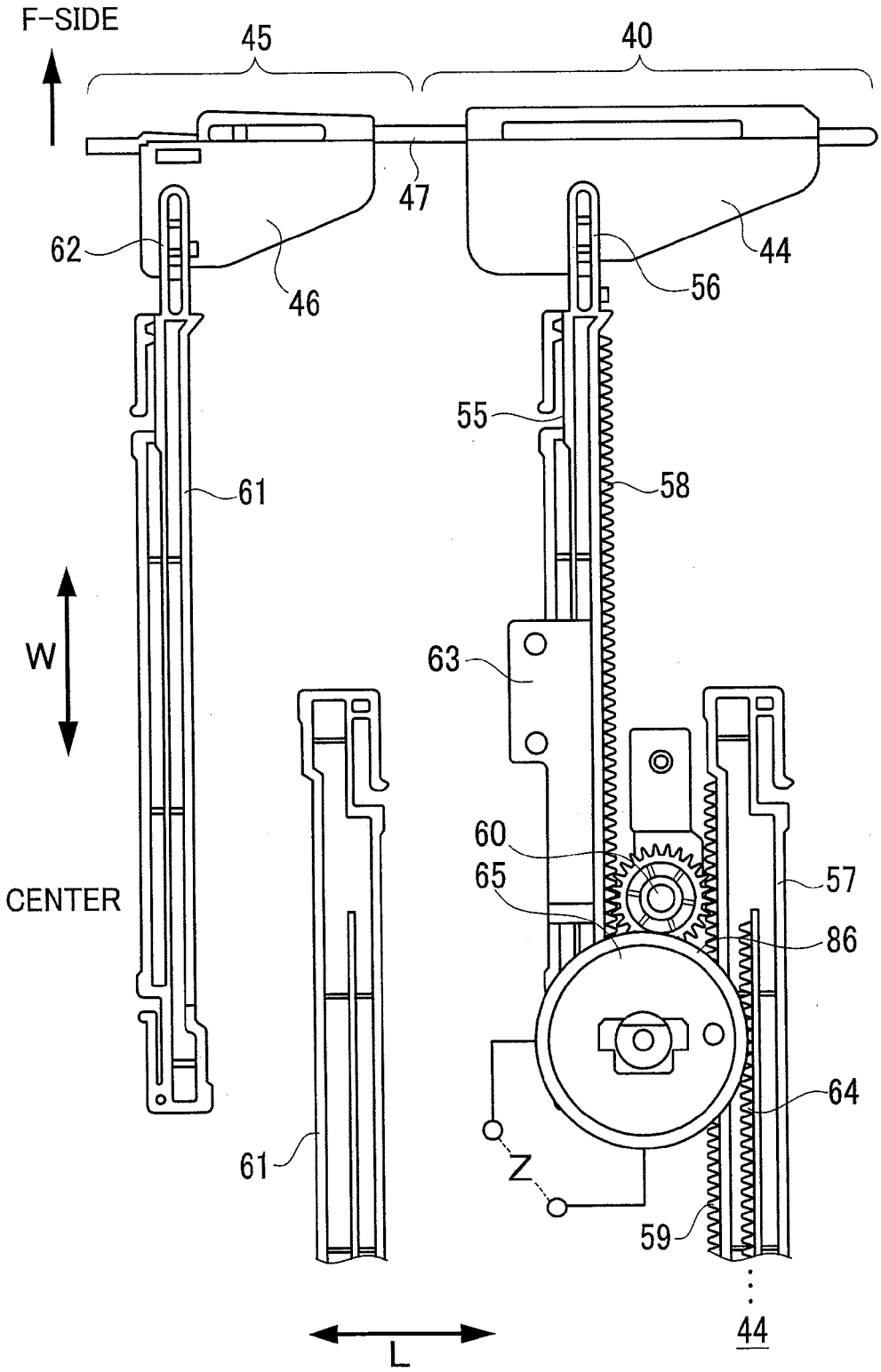
FIG. 9 is a bottom view to explain a mechanism internally placed in the manual feeding tray in the embodiment.

The manual feeding tray 40 internally contains, under the sheet stacking surface 43, a mechanism for moving the pair of sheet width regulating members 44 on the F side and the B side in a symmetric way with respect to the center in the width direction W. This mechanism will be explained below referring to a bottom view in FIG. 9. The sheet width regulating member 44, sheet width regulating member 46, and link member 47 appearing in FIG. 9 correspond to their bottom surfaces seen from below in FIGS. 2 to 6. In FIG. 9, the manual feeding tray 40, the auxiliary tray 45, and components related thereto are omitted for easy viewing of the figure.

As shown in FIG. 9, the bottom surface of the sheet width regulating member 44 (on the F side) is attached with an elongated member 55. This elongated member 55 is attached, near its end, to the bottom surface of the sheet width regulating member 44 and is placed to extend inward from the sheet width regulating member 44 in parallel to the width direction W. In the manual feeding tray 40, an attaching portion 56 of the elongated member 55 attached to the sheet width regulating member 44 is located to pass through the foregoing guide groove 53, so that the movement of the sheet width regulating member 44 in the width direction W is to be guided by the guide groove 53. The elongated member 55 is also moved in the width direction W together with the movement of the sheet width regulating member 44 in the width direction W.

Similarly, an elongated member 57 is attached to the bottom surface of the sheet width regulating member 44 on the B side, even though it is beyond the range of FIG. 9. The elongated member 55 and the elongated member 57 are arranged in parallel to each other but offset from (not aligned with) each other in the longitudinal direction L. The elongated member 55 and the elongated member 57 are formed, on mutual facing sides, with a rack teeth member 58 and a rack teeth member 59 respectively. Furthermore, a pinion gear 60 is placed between the elongated members 55 and 57. The position of the pinion gear 60 is stationary. The teeth of the pinion gear 60 can mesh with either of the rack teeth member 58 and the rack teeth member 59. Accordingly, the sheet width regulating member 44 on the F side and the sheet width regulating member 44 on the B side are allowed to move symmetrically with respect to the center in the width direction W.

At least one of the elongated member 55 and the elongated member 57 (the elongated member 55 in FIG. 9) is provided with a sliding resistance member (a resistance member) 63. This sliding resistance member 63 is fixed to the manual feeding tray 40. Thus, when the sheet width regulating member 44 is moved in the width direction W, the elongated member 55 is caused to slide with respect to the sliding resistance member 63. In this way, a certain degree of sliding resistance is generated by friction in movement of the sheet width regulating member 44 in the width direction.

This configuration can therefore prevent easy movement of the sheet width regulating members 44 even when each sheet width regulating member 44 receives a force in the width direction W generated by for example turbulence or unstable motion of a sheet(s) at the time of start of sheet feeding. Further, the sliding resistance member 63 placed in the manual feeding tray 40 can also prevent undesired movement of the sheet width regulating members 44 due to machine vibrations transmitted thereto from the main body 20 side.

One of the elongated member 55 and the elongated member 57 (the elongated member 57 in FIG. 9) is formed with another rack teeth member 64 in addition to the rack teeth member 59. The rack teeth member 64 is also parallel to the elongated member 57. A volume resistor (a width signal output section) 65 is fixedly provided in the manual feeding tray 40. Around this resistor 65, gear teeth 86 are formed and mesh with the rack teeth member 64. Accordingly, when the sheet width regulating members 44 are moved in the width direction W, causing the volume resistor 65 to rotate, the electrical resistance Z between terminals will be changed.

Upon detection of this electrical resistance Z, the main body 20 of the image forming apparatus 1 can grasp the positions of the sheet width regulating members 44, i.e., the size in the width direction W of a sheet(s) currently stacked on the manual feeding tray 40. Specifically, the volume resistor 65 is configured to output a signal representing the regulating width of the sheet width regulating members 44. Since the volume resistor 65 is mounted in the manual feeding tray 40, the positions of the sheet width regulating members 44 can be detected without being greatly influenced by noise due to mechanical vibrations of the main body 20. The main body 20 that receives the foregoing signal from the volume resistor 65 can control automatic magnification adjustment and other adjustments for image formation.

The aforementioned elongated member 57 may be provided with only the rack teeth member 59 without including the rack teeth member 64. In this case, the gear teeth 86 of the volume resistor 65 may be arranged to mesh with the rack teeth member 59 or with the pinion gear 60. As an alternative, the volume resistor 65 and the pinion gear 60 are provided coaxially and instead the gear teeth 86 may be fixed. The elongated member 55 or the elongated member 57 may be provided with a resistance wire instead of using the volume resistor 65, and the manual feeding tray 40 may be provided with a fixed contact to obtain changes in resistance value. Further, instead of the electrical resistance, electrical capacity or electrical physical quantity that changes depending on the positions of the sheet width regulating members 44 may be used. As another alternative, a signal representing the positions of the sheet width regulating members 44 may be acquired through some optical means. An elastic member that can expand and contract according to the positions of the sheet width regulating members 44 may be provided to acquire the relevant signal from its distortion.

The elongated member 61 is also provided to a back surface of the sheet width regulating member 46 on the auxiliary tray 45 as shown in FIG. 9 (the F side). Accordingly, an attaching portion 62 of the elongated member 61 attached to the sheet width regulating member 46 is located to pass through the guide groove 54, so that the movement of the sheet width regulating member 46 in the width direction W is to be guided. However, the elongated member 61 does not include any member like the sliding resistance member 63 provided in the elongated member 55. Thus, the movement itself of the sheet width regulating member 46 in the width direction generates little resistance. At least, the movement of the sheet width regulating members 44 generates higher resistance as compared with the movement of the sheet width regulating member 46. Thus, when the sheet width regulating members 44 are intentionally operated in the width direction W by a user, the low-resistance sheet width regulating members 46 smoothly go along with the corresponding sheet width regulating members 44.

Instead of providing the sliding resistance member 63, the foregoing volume resistor 65 may be configured as a resistor with a gear teeth 86 that generates a certain degree of mechanical resistance to movement.

Figure 10:
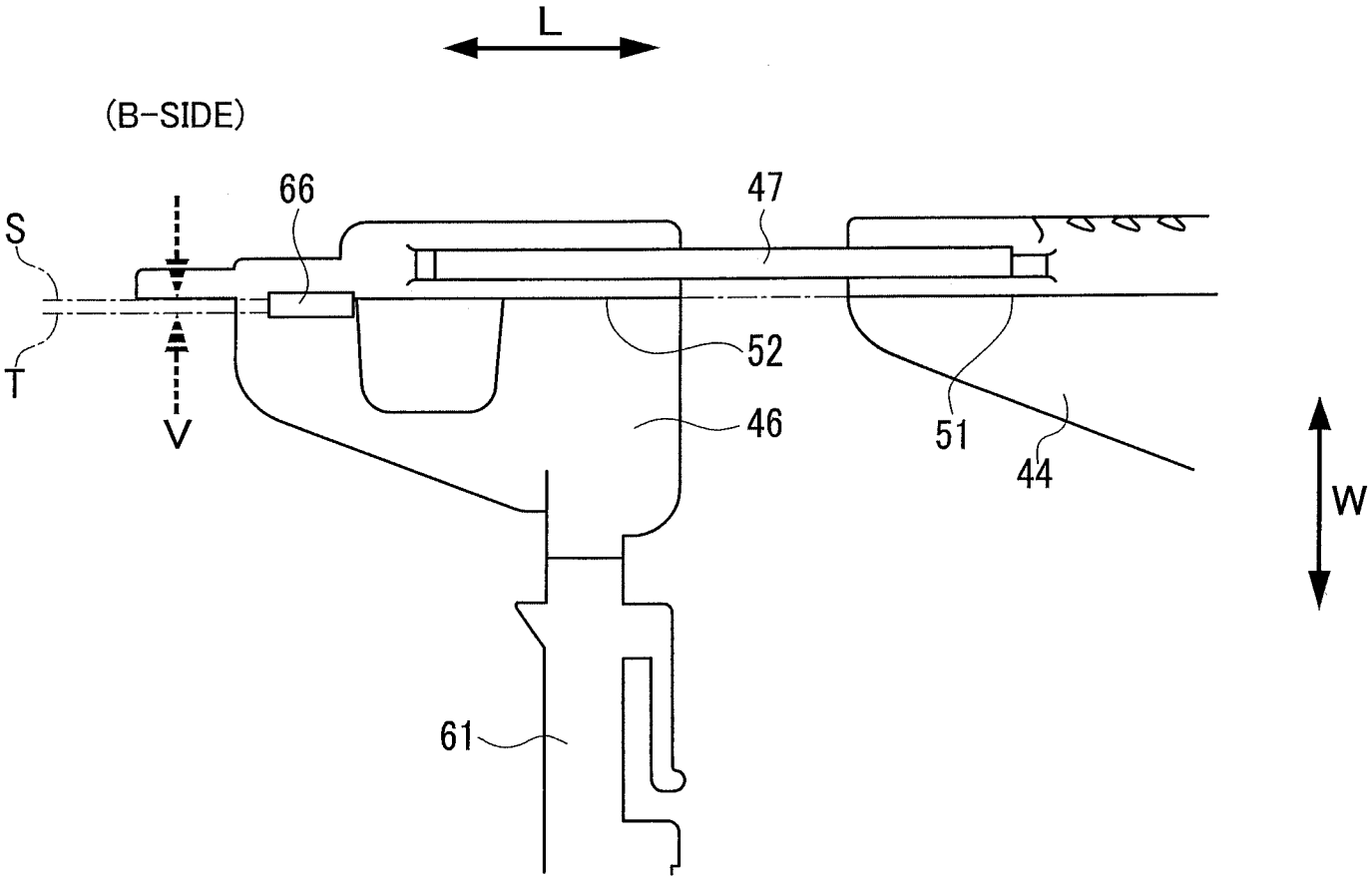
FIG. 10 is a plan view of a sheet width regulating member in the embodiment.

FIG. 10 is a plan view of the sheet width regulating member 46 on the B side seen from above. FIG. 10 shows the sheet width regulating member 46 and further part of the sheet width regulating member 44 and part of the elongated member 61. In FIG. 10, the sheet width regulating surface 51 and the sheet width regulating surface 52 are aligned on one line S. A sheet(s) is placed below the line S in FIG. 10. This is because the sheet width regulating surfaces 51 and 52 regulate the edge of the sheet(s) in the width direction W.

The sheet width regulating surface 52 of each sheet width regulating member 46 is provided with a soft member 66 projecting to a sheet side. The position of the soft member 66 in the sheet width regulating surface 52 is near a leading edge (a left end in FIG. 10) of a sheet(s) in the feeding direction (the longitudinal direction L). However, this position does not protrude forward than the leading edge of the sheet(s) stacked on the manual feeding tray 40 and the auxiliary tray 45. A distance between the line S and a line T corresponding to a front surface of the soft member 66 is referred to as a projecting amount V, which is positive. In the image forming apparatus 1 in the present embodiment, the soft member 66 is a flocked member made of cloth implanted with fibers. Other examples of the soft member 66 other than the flocked member may include a sponge member and a rubber member. The sheet width regulating member 46 on the F side is similarly provided with a soft member 66 placed near the leading edge of the sheet(s) in the feeding direction so as to project to the sheet side. The existence of these soft members 66 contributes to absorb rattles in the width direction W of the sheet width regulating member 46 positioned through the link member 47 to stably and reliably restrict sheets.

Figure 11:
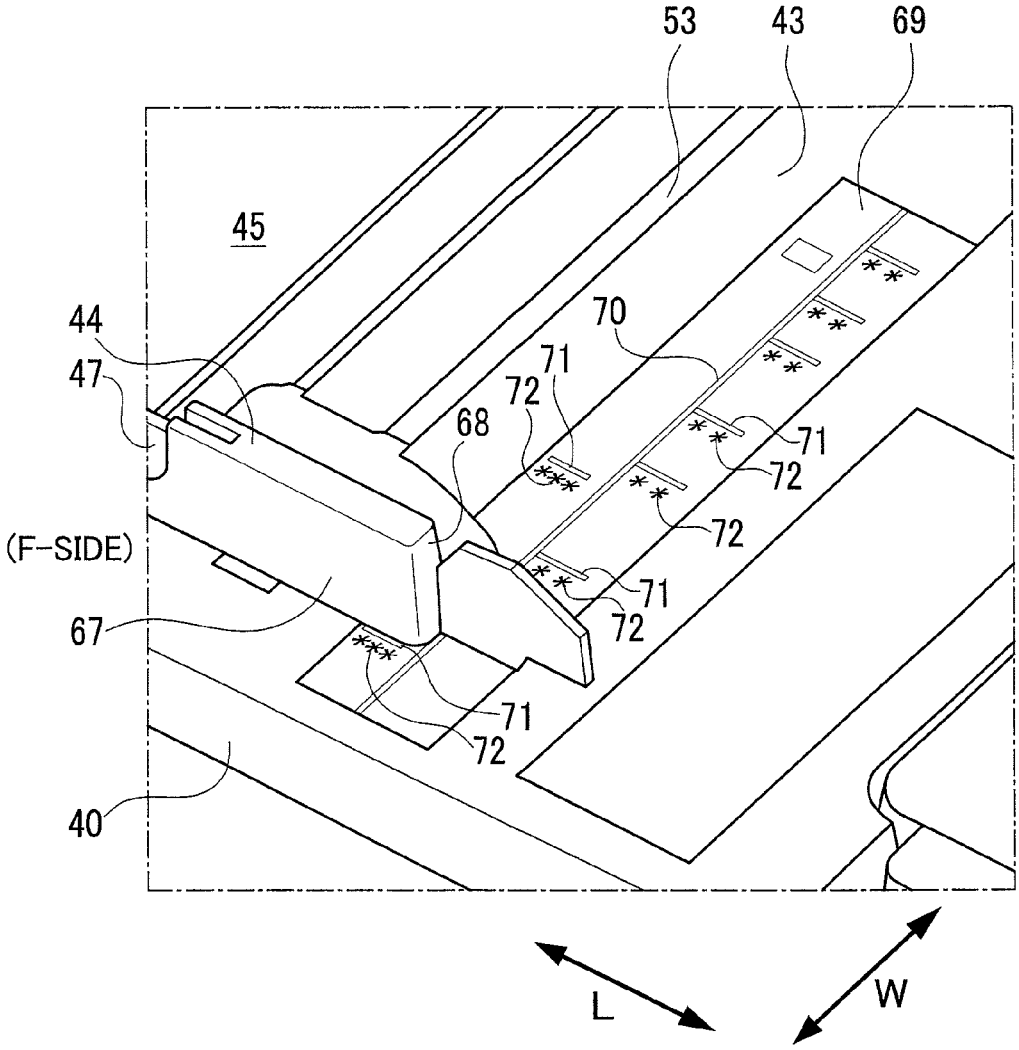
FIG. 11 is a perspective view showing a scale label on the manual feeding tray in the embodiment.

FIG. 11 is a perspective view showing part of the manual feeding tray 40. FIG. 11 shows a portion of the sheet stacking surface 43 of the manual feeding tray 40, near the sheet width regulating member 44 on the F side. FIG. 11 is a perspective view of the relevant portion seen from a user side. Accordingly, in FIG. 11, an outer surface 67 appears, which is a surface of the sheet width regulating member 44 on a side outside in the width direction W and out of contact with a sheet(s). The outer surface 67 is formed with a shoulder portion 68. The outward projecting amount of the outer surface 67 in the width direction W is different between right and left sides of the shoulder portion 68. The example shown in FIG. 11 is one example, in which the projecting amount is larger on a downstream side than on an upstream side in the feeding direction L. The shoulder portion 68 is a specific outer contour portion of the sheet width regulating member 44.

The sheet stacking surface 43 of the manual feeding tray 40 is attached with a scale label 69. Specifically, the scale label 69 is attached in an area to be overlapped by the outer surface 67, that is, in a position close to the shoulder portion 68 of the sheet width regulating member 44 on the F side on the sheet stacking surface 43. When the sheet width regulating members 44 are moved in the width direction W to fit to the sheet width, the shoulder portion 68 moves over the scale label 69. This scale label 69 is ruled with a dividing line 70 parallel to the width direction W. The dividing line 70 indicates a pathway along with the shoulder portion 68 will move as the sheet width regulating member 44 is moved in the width direction W.

The scale label 69 is further ruled with a plurality of scale lines 71 on a right side or a left side of the dividing line 70. Furthermore, a character string 72 is described under each scale line 71 in FIG. 11, that is, outside adjacent to each scale line 71 in the width direction W. Even though the character strings 72 are illustrated as simple same marks in FIG. 11, they are actually different letters or symbols according to the scale lines 71 to indicate different sheet sizes and sheet orientations. The sheet size or others indicated by each character string 72 represents the scale line 71 drawn just inside adjacent thereto in the width direction W.

Each scale line 71 is drawn at a position to which the outer surface 67 of the sheet width regulating member 44 is to be adjusted to bring the regulating width of the sheet width regulating members 44 to a target width. The target width is a width of a sheet(s) whose size and orientation indicated by the character string 72 located just outside the corresponding scale line 71. Naturally, the scale lines 71 on the right side of the dividing line 70 are drawn based on the thickness (a thinner one) of the sheet width regulating member 44 on the right side relative to the shoulder portion 68. The scale lines 71 on the left side of the dividing line 70 are drawn based on the thickness (a thicker one) of the sheet width regulating member 44 on the left side relative to the shoulder portion 68.

Using the outer shape of each sheet width regulating member 44 and the scale label 69 mentioned above can provide the following advantages. Since the scale lines 71 are drawn based on the outer surface of the sheet width regulating member 44, not based on the inner surface, it is easy for a user to visually recognize a target for positioning of the sheet width regulating member 44. This is because a user who stands on the front side (on the F side in FIG. 2) of the main body 20 can more easily identify the position of the outer surface than the inner surface of the sheet width regulating member 44 on the sheet stacking surface 43. Since the character strings 72 are placed in positions just outside the corresponding scale lines 71 in the width direction W, a user can easily recognize the sheet size and orientation corresponding to the adjusted position. This is because while the sheet width regulating member 44 is in an adjusted state, the character string 72 corresponding to the adjusted state is not covered under the sheet width regulating member 44.

Furthermore, a scale line conformal to the shape of the shoulder portion 68 of the sheet width regulating member 44 may be drawn across both sides of the dividing line 70. Such a scale line cannot be adjusted to the inner surface of the sheet width regulating member 44 because this inner surface is linear. Therefore, even a user who has less experience with the image forming apparatus 1 is less likely to erroneously adjust the sheet width regulating member 44. It is to be noted that the dividing line 70 is not indispensable.

According to the present embodiment explained in detail above, there are provided the sheet width regulating members 44 on the manual feeding tray 40 and the sheet width regulating members 46 on the auxiliary tray 45 as the members used for sheet-width regulation on the manual feeding tray 40. The sheet width regulating members 44 are connected to the corresponding sheet width regulating members 46 through the link members 47 to enable simultaneous adjustment of the regulating width of the sheet width regulating members 44 and the sheet width regulating members 46.

This can provide the following advantages. One advantage is that the sheet width regulating can be performed both on the manual feed tray 40 and on the auxiliary tray 45. Accordingly, even if the sheet width regulating members 44 and the sheet width regulating members 46 are each small in size, the total size of the sheet width regulating members 44 and 46 enables the width regulating over a relatively wide area with respect to the sheet longitudinal direction L. This allows reliable sheet-width regulating and less causes skewed feeding. Since the sheet width regulating members 46 are particularly placed on the auxiliary tray 45, they regulate the sheet width on a just upstream side of the manual sheet feeding roller 41 corresponding to a subsequent sheet feeding member. Thus, the sheet width regulating members 46 largely contribute to the sheet skew preventing function. According to the image forming apparatus 1 in the present embodiment configured as above, there can be realized the sheet feeder capable of properly feeding a sheet(s) stacked on the manual feeding tray 40 without causing sheet skewing even where the sheet feeder has an apparatus structure adapted to downsizing, and the image forming apparatus 1 using the sheet feeder.

As another advantage, it is easy for a user to perform an operation of adjusting the regulating width of the sheet width regulating members 44. Even if the sheet width regulating members 44 and the sheet width regulating members 46 are each small in size, the total size of the sheet width regulating members 44 and 46 is large enough to be conspicuous. As still another advantage, the sheet width regulating members 44 placed on the manual feeding tray 40 protruding from the main body 20 makes it easy for a user to reach the sheet width regulating members 44.

According to the present embodiment described above, there are provided the sheet feeder capable of properly feeding a sheet(s) stacked on the tray without causing sheet skewing even if the apparatus structure is adapted to downsizing, and the image forming apparatus using the sheet feeder.

The present embodiment is a mere example and does not give any limitations to the present invention. Thus, the present invention may be embodied in other specific forms without departing from the essential characteristics thereof. For instance, the image forming apparatus 1 shown in FIG. 1 is a tandem color printer, but it is not limited thereto. The image forming section 21 may be a multi-cycle color image forming section other than the tandem type or may be a monochromatic image forming section. The image forming type itself is also not limited to a toner type and may be any types such as a type using liquid color former, a thermosensitive type, and a silver-halide type. The image forming apparatus may be a copying machine having a built-in scanner function or may have a job transmitting/receiving function using a public network. As still another alternative, it may have a double-side printing function or a post-processing function.

In the sheet feeder configured as above, furthermore, it is preferable that the link member has: a first end attached to one of the first width regulating member and the second width regulating member so that the link member is rotatable about an axis parallel to the sheet width direction at the first end and is fixed to the width regulating member in the sheet width direction; and a second end attached to the other one of the first width regulating member and the second width regulating member so that the link member can perform sliding movement in a sheet feeding direction at the second end and is fixed to the other width regulating member in the sheet width direction. Accordingly, the link member configured as above can deal with both interlocking of the first width regulating member and the second width regulating member in width-direction movement and changes in distance between the first width regulating member and the second width regulating member in association with opening/closing operations of the sheet stacking tray.

In the above case, additionally, it is preferable that the second end of the link member includes a rounded portion formed in a convex shape located in contact with one of the sheet stacking tray and the auxiliary tray, the one of the sheet stacking tray and the auxiliary tray includes a guide groove in a position within a range where the rounded portion can contact the guide groove during the sliding movement, the guide groove being configured to guide the regulating width changing operation of the first width regulating member or second width regulating member, and the convex shape of the rounded portion has a curvature of radius larger than a groove width of the guide groove. With the above configuration, even when the rounded portion moves across the guide groove in the sliding movement, the rounded portion does not deeply fall into the guide groove. Thus, the sliding movement is performed smoothly. This enables the opening/closing operation of the sheet stacking tray without difficulty.

As an alternative to the foregoing, preferably, the link member has: a first end attached to one of the first width regulating member and the second width regulating member so that the link member is rotatable about an axis parallel to the sheet width direction at the first end and is fixed to the width regulating member in the sheet width direction; and a second end attached to the other one of the first width regulating member and the second width regulating member so that the link member is rotatable about an axis parallel to the sheet width direction at the second end and is fixed to the other width regulating member in the sheet width direction, and a distance between the first end and the second end is variable. This configuration can also deal with both interlocking of the first width regulating member and the second width regulating member in width-direction movement and changes in distance between the first width regulating member and the second width regulating member in association with the opening/closing operations of the sheet stacking tray.

In the sheet feeder configured as above, preferably, the sheet stacking tray is provided with a resistance member configured to generate higher operating resistance of the first width regulating member in the regulating width changing operation than operating resistance of the second width regulating member in the regulating width changing operation. The "resistance" used herein means frictional resistance to mechanical movement of a component, not electrical resistance. The existence of the resistance member can prevent the first width regulating member from unintentionally moving due to turbulence or unstable motion of a sheet(s) at the time of start of sheet feeding. Since the resistance member is provided on the sheet stacking tray side, resistance properties to machine vibrations transmitted from the main body to the sheet stacking tray has been improved. In contrast, the operating resistance of the second width regulating member on the auxiliary tray side is low. Thus, the second width regulating member can accompany well the movement of the first width regulating member operated by a user.

In the sheet feeder provided with the foregoing resistance member, furthermore, it is preferable that the sheet stacking tray is provided with a width signal output section configured to output a signal representing a regulating width of the first width regulating member. Accordingly, the main body can grasp what sheet width the first width regulating member and the second width regulating member are adjusted to. Further, since the width signal output section is located on the sheet stacking tray side as with the resistance member, any noise due to vibration transmitted from the main body side is less likely to enter the output signal.

In the sheet feeder in the above embodiment, alternatively, it is preferable that the second width regulating member includes a pair of second width regulating members arranged one on each side in the sheet width direction, and each of the second width regulating members has a regulating surface for regulating the side edge of the sheet in the width direction and is provided with a soft contact member projecting from the regulating surface to a sheet side. The second width regulating member is interlocked with the first width regulating member through the link member. Thus, rattles to a certain extent may be caused with respect to an end position of a regulated sheet. Therefore, the contact members are placed on the sheet side to absorb the rattles, thereby enabling excellent width-direction regulating.

In the sheet feeder configured as above, it is preferable that the first width regulating member includes a pair of first width regulating members, one of which is located on a front side of the main body and has an outer surface located outside in the sheet width direction, the outer surface being formed with a specific outer contour portion having different protruding amounts in the sheet width direction according to positions in the sheet feeding direction, and the sheet stacking tray has a stacking surface including an area to be overlapped by the specific outer contour portion, the area being provided with: a scale line described along a shape of the specific outer contour portion, the scale line representing a position to which the specific outer contour portion is to be adjusted when a position of the first width regulating member in the sheet width direction is set to fit sheet size; and a character located in a position to a front side of the main body than the scale line, the character specifying the sheet size indicated by the scale line. Accordingly, when a user operates the first width regulating member, he/she is less likely to wrongly adjust the first width regulating member to the scale line based on the inner surface. Further, during adjustment of the first width regulating member, the character assigned to the scale line to which the first width regulating member is to be adjusted is kept visible without getting under the first width regulating member.

Explanations of Reference Signs

1 Image forming apparatus
20 Main body
21 Image forming section
40 Manual feeding tray (Sheet stacking tray)
42 Rotating shaft
43 Sheet stacking surface
44 Sheet width regulating member (First width regulating member)
45 Auxiliary tray
46 sheet-width regulating member (Second width regulating member)
47 Link member
48 Boss
49 Engagement portion
50 Rounded portion
51 Sheet width regulating surface
52 Sheet width regulating surface
53 Guide groove
54 Guide groove
63 Sliding resistance member (Resistance member)
65 Volume resistor (Width signal output section)
66 Soft member
67 Outer surface
71 Scale line
72 Character string
73 Link member
77 Link member

What is claimed is:

1. A sheet feeder comprising:

a sheet stacking tray provided to stack a sheet to be supplied to a main body, the sheet stacking tray being configured to be opened and closed with respect to the main body by rotation about a rotation axis defined in a direction perpendicular to a sheet feeding direction;

a first width regulating member provided in the sheet stacking tray and configured to regulate a side edge of the sheet in a sheet width direction and movable in the sheet width direction;

an auxiliary tray provided at a position in the main body where the auxiliary tray does not move in association with an opening/closing operation of the sheet stacking tray, the auxiliary tray being configured to stack the sheet in cooperation with the sheet stacking tray;

a second width regulating member provided in the auxiliary tray and configured to regulate the side edge of the sheet in the sheet width direction and movable in the sheet width direction;

a link member interlocking the first width regulating member and the second width regulating member such that the first width regulating member and the second width regulating member move in sync in the sheet width direction; and a sheet feeding member provided in the main body and configured to feed one by one the sheets stacked over the sheet stacking tray and the auxiliary tray;

wherein the link member comprises:

a first end attached to one of the first width regulating member and the second width regulating member so that the link member is rotatable about an axis parallel to the sheet width direction at the first end and is fixed to the width regulating member in the sheet width direction; and a second end attached to the other one of the first width regulating member and the second width regulating member so that the link member can perform sliding movement in a sheet feeding direction at the second end and is fixed to the other width regulating member in the sheet width direction.

2. The sheet feeder according to claim 1, wherein the second end of the link member includes a rounded portion formed in a convex shape located in contact with one of the sheet stacking tray and the auxiliary tray, the one of the sheet stacking tray and the auxiliary tray includes a guide groove in a position within a range where the rounded portion can contact the guide groove during the sliding movement, the guide groove being configured to guide the regulating width changing operation of the first width regulating member or second width regulating member, and the convex shape of the rounded portion has a curvature of radius larger than a groove width of the guide groove.

3. The sheet feeder according to claim 1, wherein the link member has:

a first end attached to one of the first width regulating member and the second width regulating member so that the link member is rotatable about an axis parallel to the sheet width direction at the first end and is fixed to the width regulating member in the sheet width direction; and a second end attached to the other one of the first width regulating member and the second width regulating member so that the link member is rotatable about an axis parallel to the sheet width direction at the second end and is fixed to the other width regulating member in the sheet width direction, and a distance between the first end and the second end is variable.

4. The sheet feeder according to claim 3, wherein the sheet stacking tray is provided with a resistance member configured to generate higher operating resistance of the first width regulating member in the regulating width changing operation than operating resistance of the second width regulating member in the regulating width changing operation.

5. The sheet feeder according to claim 3, wherein the second width regulating member includes a pair of second width regulating members arranged one on each side in the sheet width direction, and each of the second width regulating members has a regulating surface for regulating the side edge of the sheet in the width direction and is provided with a soft contact member projecting from the regulating surface to a sheet side.

6. The sheet feeder according to claim 3, wherein the first width regulating member includes a pair of first width regulating members, one of which is located on a front side of the main body and has an outer surface located outside in the sheet width direction, the outer surface being formed with a specific outer contour portion having different protruding amounts in the sheet width direction according to positions in the sheet feeding direction, and the sheet stacking tray has a stacking surface including an area to be overlapped by the specific outer contour portion, the area being provided with:

a scale line described along a shape of the specific outer contour portion, the scale line representing a position to which the specific outer contour portion is to be adjusted when a position of the first width regulating member in the sheet width direction is set to fit sheet size; and a character located in a position to a front side of the main body than the scale line, the character specifying the sheet size indicated by the scale line.

7. The sheet feeder according to claim 1, wherein the sheet stacking tray is provided with a resistance member configured to generate higher operating resistance of the first width regulating member in the regulating width changing operation than operating resistance of the second width regulating member in the regulating width changing operation.

8. The sheet feeder according to claim 7, wherein the sheet stacking tray is provided with a width signal output section configured to output a signal representing a regulating width of the first width regulating member.

9. The sheet feeder according to claim 7, wherein the second width regulating member includes a pair of second width regulating members arranged one on each side in the sheet width direction, and each of the second width regulating members has a regulating surface for regulating the side edge of the sheet in the width direction and is provided with a soft contact member projecting from the regulating surface to a sheet side.

10. The sheet feeder according to claim 7, wherein the first width regulating member includes a pair of first width regulating members, one of which is located on a front side of the main body and has an outer surface located outside in the sheet width direction, the outer surface being formed with a specific outer contour portion having different protruding amounts in the sheet width direction according to positions in the sheet feeding direction, and the sheet stacking tray has a stacking surface including an area to be overlapped by the specific outer contour portion, the area being provided with:

a scale line described along a shape of the specific outer contour portion, the scale line representing a position to which the specific outer contour portion is to be adjusted when a position of the first width regulating member in the sheet width direction is set to fit sheet size; and a character located in a position to a front side of the main body than the scale line, the character specifying the sheet size indicated by the scale line.

11. The sheet feeder according to claim 1, wherein the sheet stacking tray is provided with a resistance member configured to generate higher operating resistance of the first width regulating member in the regulating width changing operation than operating resistance of the second width regulating member in the regulating width changing operation.

12. The sheet feeder according to claim 1, wherein the second width regulating member includes a pair of second width regulating members arranged one on each side in the sheet width direction, and each of the second width regulating members has a regulating surface for regulating the side edge of the sheet in the width direction and is provided with a soft contact member projecting from the regulating surface to a sheet side.

13. The sheet feeder according to claim 12, wherein the first width regulating member includes a pair of first width regulating members, one of which is located on a front side of the main body and has an outer surface located outside in the sheet width direction, the outer surface being formed with a specific outer contour portion having different protruding amounts in the sheet width direction according to positions in the sheet feeding direction, and the sheet stacking tray has a stacking surface including an area to be overlapped by the specific outer contour portion, the area being provided with:

a scale line described along a shape of the specific outer contour portion, the scale line representing a position to which the specific outer contour portion is to be adjusted when a position of the first width regulating member in the sheet width direction is set to fit sheet size; and a character located in a position to a front side of the main body than the scale line, the character specifying the sheet size indicated by the scale line.

14. The sheet feeder according to claim 1, wherein the second width regulating member includes a pair of second width regulating members arranged one on each side in the sheet width direction, and each of the second width regulating members has a regulating surface for regulating the side edge of the sheet in the width direction and is provided with a soft contact member projecting from the regulating surface to a sheet side.

15. The sheet feeder according to claim 1, wherein the first width regulating member includes a pair of first width regulating members, one of which is located on a front side of the main body and has an outer surface located outside in the sheet width direction, the outer surface being formed with a specific outer contour portion having different protruding amounts in the sheet width direction according to positions in the sheet feeding direction, and the sheet stacking tray has a stacking surface including an area to be overlapped by the specific outer contour portion, the area being provided with:

a scale line described along a shape of the specific outer contour portion, the scale line representing a position to which the specific outer contour portion is to be adjusted when a position of the first width regulating member in the sheet width direction is set to fit sheet size; and a character located in a position to a front side of the main body than the scale line, the character specifying the sheet size indicated by the scale line.

16. The sheet feeder according to claim 1, wherein the first width regulating member includes a pair of first width regulating members, one of which is located on a front side of the main body and has an outer surface located outside in the sheet width direction, the outer surface being formed with a specific outer contour portion having different protruding amounts in the sheet width direction according to positions in the sheet feeding direction, and the sheet stacking tray has a stacking surface including an area to be overlapped by the specific outer contour portion, the area being provided with:

a scale line described along a shape of the specific outer contour portion, the scale line representing a position to which the specific outer contour portion is to be adjusted when a position of the first width regulating member in the sheet width direction is set to fit sheet size; and a character located in a position to a front side of the main body than the scale line, the character specifying the sheet size indicated by the scale line.

17. An image forming apparatus comprising: an image forming section; and a sheet feeder configured to supply a sheet to the image forming section, wherein the sheet feeder has a configuration described in claim 1.

18. The image forming apparatus according to claim 17, wherein the link member has:

a first end attached to one of the first width regulating member and the second width regulating member so that the link member is rotatable about an axis parallel to the sheet width direction at the first end and is fixed to the width regulating member in the sheet width direction; and a second end attached to the other one of the first width regulating member and the second width regulating member so that the link member is rotatable about an axis parallel to the sheet width direction at the second end and is fixed to the other width regulating member in the sheet width direction, and a distance between the first end and the second end is variable.

19. The sheet feeder according to claim 1, wherein the second end of the link member is inserted in an opening which is formed on an end part of the other one of the first width regulating member and the second width regulating member.

20. The sheet feeder according to claim 1, wherein the rotation axis of the sheet stacking tray is positioned below a sheet stacking surface of the sheet stacking tray.

21. The sheet feeder according to claim 1, wherein a rotation axis of the link member is different from the rotation axis of the sheet stacking tray.

* * * * *